US007138908B2

(12) United States Patent
Lu

(10) Patent No.: US 7,138,908 B2
(45) Date of Patent: Nov. 21, 2006

(54) ENGINE STARTER FOR REMOTE-CONTROL TOY CAR

(76) Inventor: Ke-Way Lu, 3F, No. 322, Sec. 6, Min-Chuan E. Rd., Taipei City (TW)

( * ) Notice: Subject to any disclaimer, the term of this patent is extended or adjusted under 35 U.S.C. 154(b) by 560 days.

(21) Appl. No.: 10/694,929

(22) Filed: Oct. 27, 2003

(65) Prior Publication Data

US 2005/0106992 A1 May 19, 2005

(51) Int. Cl.
*B60R 25/10* (2006.01)

(52) U.S. Cl. ..... 340/426.13; 446/454; 123/179.2; 123/179.25; 74/6

(58) Field of Classification Search ..... 340/426.13, 340/426.11, 426.12, 426.17, 431; 446/454, 446/431, 460, 462; 123/179.2, 179.25, 179.5, 123/185.7, DIG. 3; 74/6, 7 E; 310/83, 112
See application file for complete search history.

(56) References Cited

U.S. PATENT DOCUMENTS

| | | | | |
|---|---|---|---|---|
| 4,183,341 | A | 1/1980 | Eastman | 123/179 A |
| 4,335,318 | A | 6/1982 | Mabuchi et al. | 290/31 |
| 4,976,650 | A * | 12/1990 | Watanabe | 446/418 |
| 5,095,865 | A | 3/1992 | Keister | 123/179.5 |
| 5,163,335 | A * | 11/1992 | Isom et al. | 74/6 |
| 5,844,336 | A * | 12/1998 | Ohya et al. | 310/80 |
| 6,692,334 | B1 | 2/2004 | Lu | 446/454 |
| 6,837,202 | B1 * | 1/2005 | Lu | 123/179.27 |
| 6,857,331 | B1 * | 2/2005 | Yeh | 74/7 C |

* cited by examiner

*Primary Examiner*—Anh V. La
(74) *Attorney, Agent, or Firm*—Ladas & Parry LLP

(57) ABSTRACT

An engine starter adapted to substitute for the traction rope type engine starter of the engine of a remote-control toy car is constructed to include a casing covered with a cover plate to hold a cushion, a driven bevel gear, a driving bevel gear, a locating block and a locating cap on the inside for enabling the starter rod of an electric auxiliary starter to be coupled to the polygonal coupling hole at the driven bevel gear and operated to start the engine.

4 Claims, 9 Drawing Sheets

ENGINE STARTER FOR REMOTE-CONTROL TOY CAR

BACKGROUND OF THE INVENTION

1. Field of the Invention

The present invention relates an engine starter for remote-control toy car and, more particularly, to such an engine starter that can be used to substitute for the traction rope type engine starter of a conventional remote-control toy car.

2. Description of the Related Art

A conventional remote-control toy car uses a traction rope type engine starter to start the engine (see FIG. 12). It is difficult to start the engine with the traction rope. When operating the traction rope type engine starter, the traction rope may break easily, or the user's hand tends to be injured by the traction rope. Further, before starting the engine, the user must open the engine hood so that the user can start the concealed engine. When started, the user must close the engine hood again to keep the engine from sight.

In order to eliminate the aforesaid drawbacks, electric engine starters are developed. A conventional electric engine starter is known comprising a platform carrying a motor, a switch, a transmission gear, and a power cord. During operation, the user must couple the crank of the engine to the transmission gear and connect the power cord to an external battery pack (for example, the battery power supply of a motor vehicle), and then switch on the switch to start the motor, causing the motor to turn the transmission gear and then the engine of the remote-control toy car. This design of electric engine starter is still not satisfactory in function because of the disadvantages of heavy weight and limited to the availability of external battery power supply.

U.S. Pat. No. 6,692,334B2 discloses an electric auxiliary engine starter, which was invented by the present inventor. This design of electric auxiliary engine starter is functional. According to this design, the electric auxiliary engine starter uses a starter rod for coupling to a back center hole of the engine of a remote-control toy car to start the engine. However, this design of electric auxiliary engine starter is not suitable for all designs of remote-control toy cars. The oil tank or other parts of the engine of other designs of remote-control toy car may hinder the insertion of the starter rod into the back center hole of the engine.

SUMMARY OF THE INVENTION

The present invention has been accomplished under the circumstances in view. It is the main object of the present invention to provide an engine starter, which is practical for use to substitute for the traction rope type engine starter of a remote-control toy car. It is another object of the present invention to provide an engine starter that can easily be installed in the engine of a remote-control toy car after removal of the traction rope type engine starter of the remote-control toy car. It is still another object of the present invention to provide an engine starter, which can be selectively installed in the engine of a remote-control toy car in one of multiple mounting positions subject to the user's convenience.

To achieve these and other objects of the present invention, the engine starter comprises a casing; a cushion mounted inside the casing, the cushion having an axially extended center through hole; a driven bevel gear mounted inside the casing, the driven bevel gear having a polygonal center through hole axially aligned with the axially extended center through hole of the cushion; a driving bevel gear mounted in the casing, the driving bevel gear having a polygonal coupling hole disposed at one side thereof outside the casing and a coupling rod axially disposed at an opposite side thereof opposite to the polygonal coupling hole; a locating block mounted on the coupling rod of the driving bevel gear inside the casing; a locating cap fixedly fastened to the casing to hold the driving bevel gear inside the casing for enabling the driving bevel gear to be rotated relative to the locating cap; and a cover plate covered on the casing to hold the cushion, the driven bevel gear, the driving bevel gear, the locating block and the locating cap in place.

DETAILED DESCRIPTION OF THE INVENTION

Figure 8:
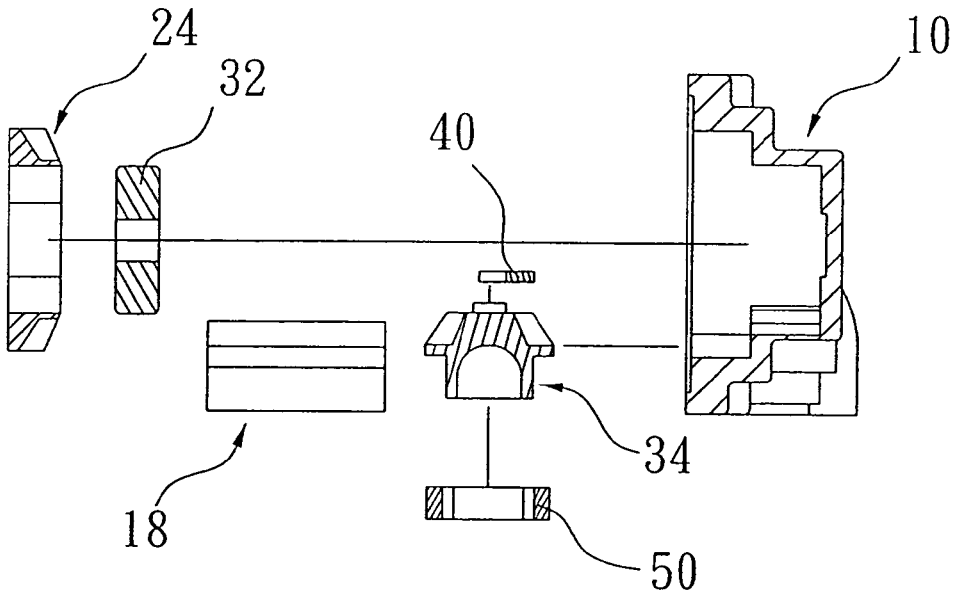
FIG. 8 is an exploded view in section of the engine starter according to the present invention.
Figure 9:
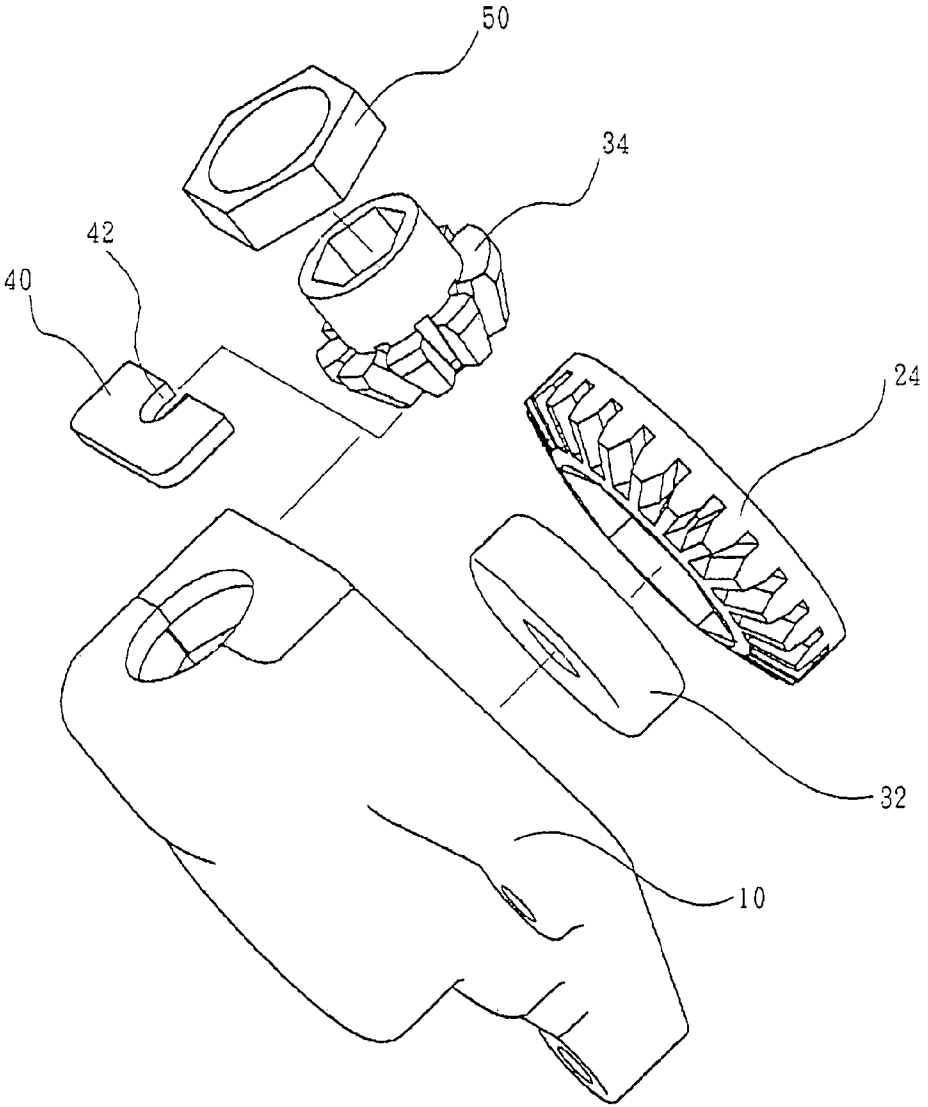
FIG. 9 is an elevational exploded view of the engine starter according to the present invention.

Referring to FIGS. 8 and 9, an engine starter 100 in accordance with the present invention is shown comprising a casing 10, a driving bevel gear 34, a driven bevel gear 24, a cushion 32, a locating block 40, a locating cap 50, and a cover plate 18.

Figure 1A:
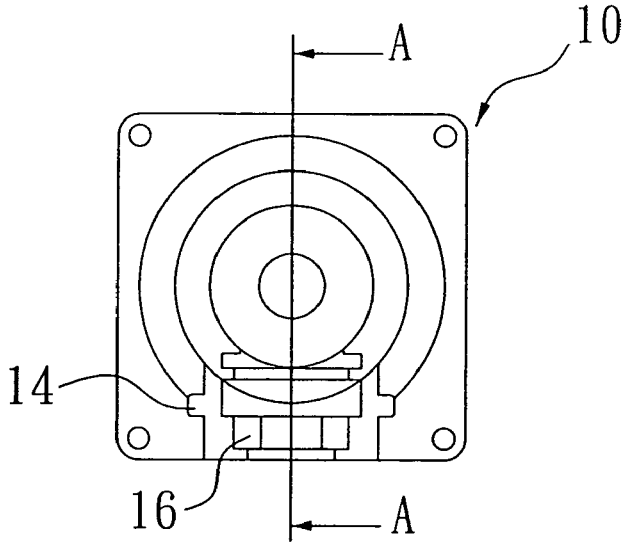
FIG. 1A is a front plain view of an engine starter according to the present invention.
Figure 1B:
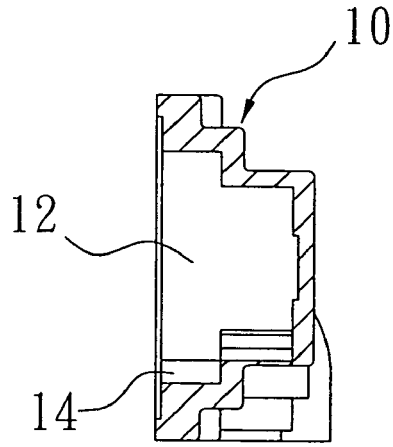
FIG. 1B is a sectional view taken along line B—B of FIG. 1A.

Referring to FIGS. 1A and 1B, the casing 10 has a receiving open chamber 12, two sliding grooves 14 axially symmetrically disposed at two sides in the receiving open chamber 12, and a multi-angle hole 16 at the bottom side.

Figure 2:
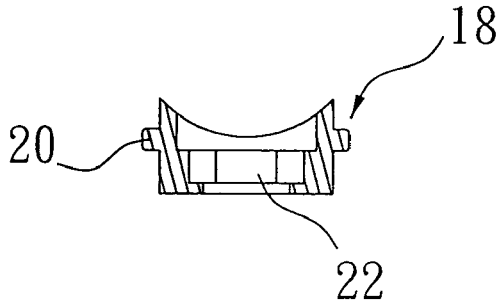
FIG. 2 is a sectional plain view of the cover plate of the engine starter according to the present invention.

Referring to FIG. 2, the cover plate 18 has two sliding rails 20 symmetrically disposed at two sides corresponding to the sliding grooves 14, a multi-angle hole 22 disposed at the bottom side and complementary to the multi-angle hole 16 of the casing 10 for forming with the multi-angle hole 16 a polygonal hole.

Figure 3A:
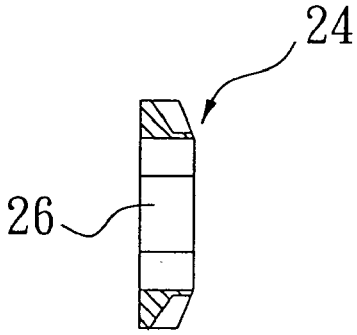
FIG. 3A is a side view in section of the driven bevel gear for the engine starter according to the present invention.
Figure 3B:
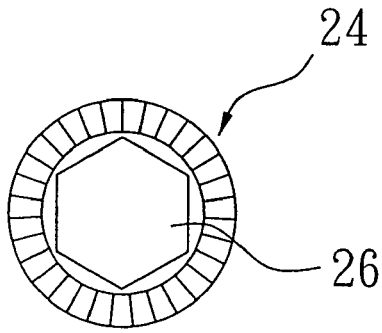
FIG. 3B is a front plain view of the driven bevel gear for the engine starter according to the present invention.

Referring to FIGS. 3A and 3B, the driven bevel gear 24 has a polygonal center through hole 26.

Figure 4A:
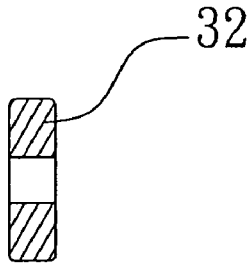
FIG. 4A is a side view in section of the cushion for the engine starter according to the present invention.
Figure 4B:
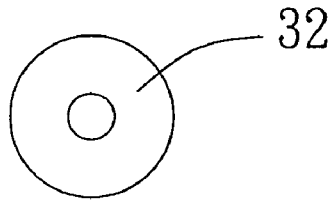
FIG. 4B is a front plain view of the cushion for the engine starter according to the present invention.

Referring to FIGS. 4A and 4B, the cushion 32 is an annular member having an axially extended center through hole.

Figure 5A:
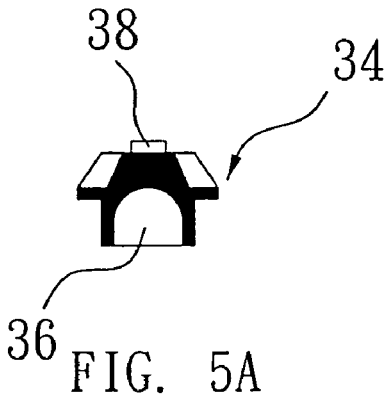
FIG. 5A is a plain view in section of the driving bevel gear for the engine starter according to the present invention.
Figure 5B:
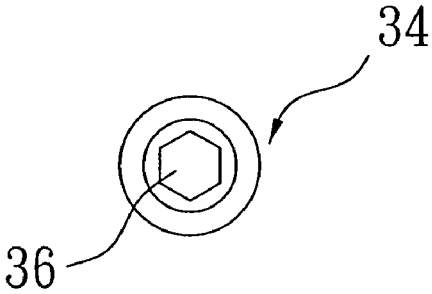
FIG. 5B is an end plain view of the driving bevel gear for the engine starter according to the present invention.

Referring to FIGS. 5A and 5B, the driving bevel gear 34 has a polygonal coupling hole 36 disposed at one side, and a coupling rod 38 axially disposed at the other side.

Figure 6A:
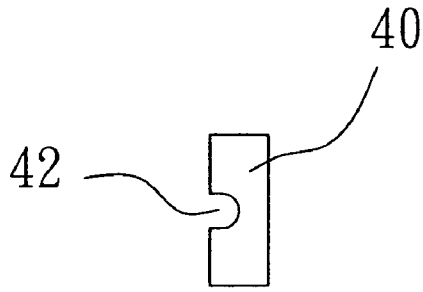
FIG. 6A is a top plain view of the locating block for the engine starter according to the present invention.
Figure 6B:
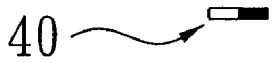
FIG. 6B is a side plain view of the locating block for the engine starter according to the present invention.

Referring to FIGS. 6A and 6B, the locating block 40 is a rectangular block having a semicircular notch 42 at one side.

Figure 7:
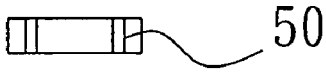
FIG. 7 is a plain view of the locating cap for the engine starter according to the present invention.

Referring to FIG. 7, the locating cap 50 is a polygonal cap fitting the polygonal hole formed of the aforesaid multi-angle holes 22 and 16, having an axially extended center through hole adapted to accommodate the driving bevel gear 34.

The assembly process of the engine starter 100 is outlined hereinafter with reference to FIG. 8. The cushion 32 is fitted into the receiving open chamber 12 inside the casing 10, and then the semicircular notch 42 of the locating block 40 is attached to the coupling rod 38 of the driving bevel gear 34, and then the locating block 40 with the driving bevel gear 34 are inserted into the receiving open chamber 12 inside the casing 10 for enabling the gear shaft of the driving bevel gear 34 to extend out of the multi-angle hole 16 of the casing 10, and then the driven bevel gear 24 is put in the receiving open chamber 12 inside the casing 10 and set into engagement with the driving bevel gear 34, and then the sliding rails 20 of the cover plate 18 are respectively inserted into the sliding grooves 14, and then screws are used to fixedly secure the cover plate 18 to the casing 10 so as to hold the driving bevel gear 34, the driven bevel gear 24, the locating block 40 and the cushion 32 inside the receiving open chamber 12, and then the locating cap 50 is fitted into the polygonal hole of the aforesaid multi-angle holes 22 and 16, for enabling the gear shaft of the driving bevel gear 34 to extend out of the axially extended center through hole of the locating cap 50.

Figure 10A:
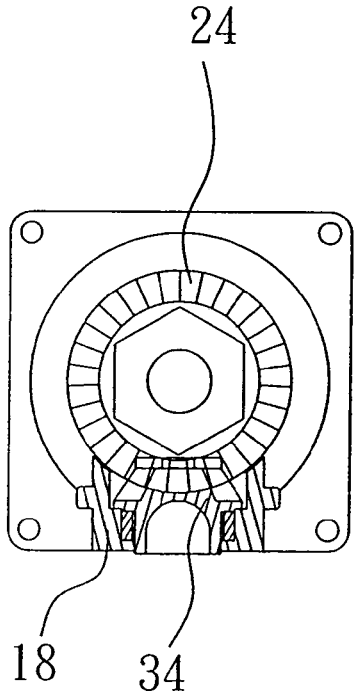
FIG. 10A is a sectional plain view taken along line B—B of FIG. 10B.
Figure 10B:
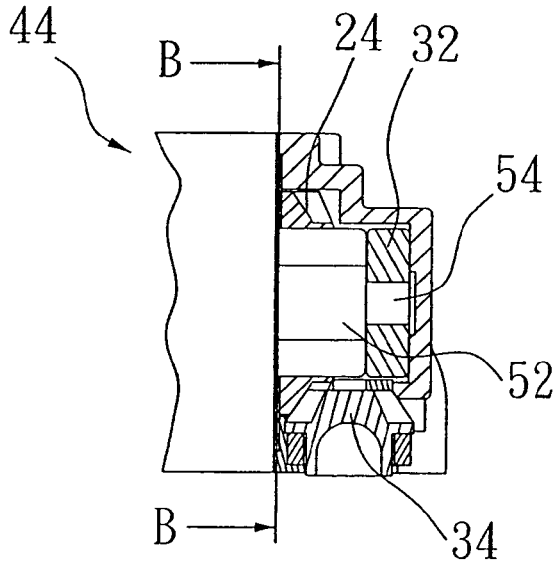
FIG. 10B is a side plain view in section of the present invention, showing the engine starter installed in the engine and the polygonal coupling hole of the driving bevel gear facing downwards.
Figure 11:
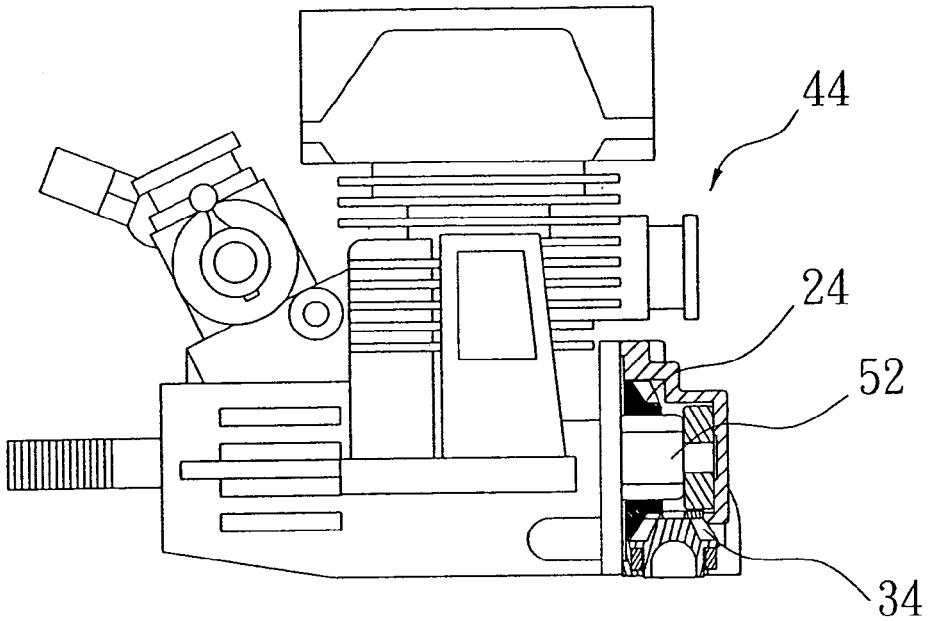
FIG. 11 is a schematic drawing showing an application example of the present invention before insertion of the starter rod of the electric auxiliary starter into the polygonal coupling hole of the driving bevel gear.
Figure 11:
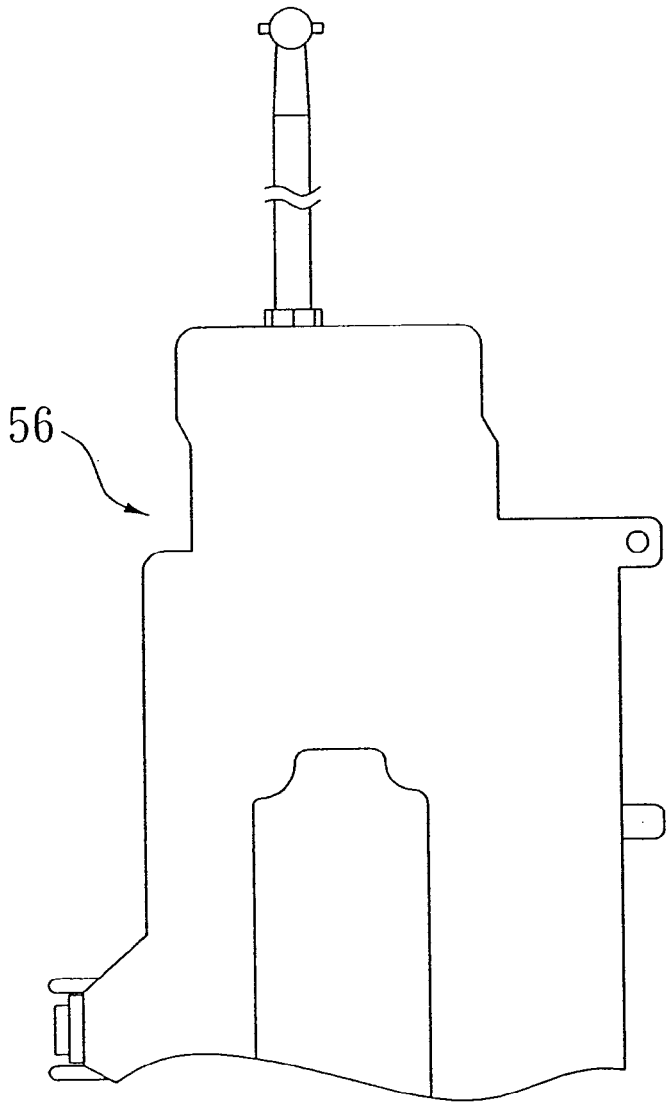
Figure 12:
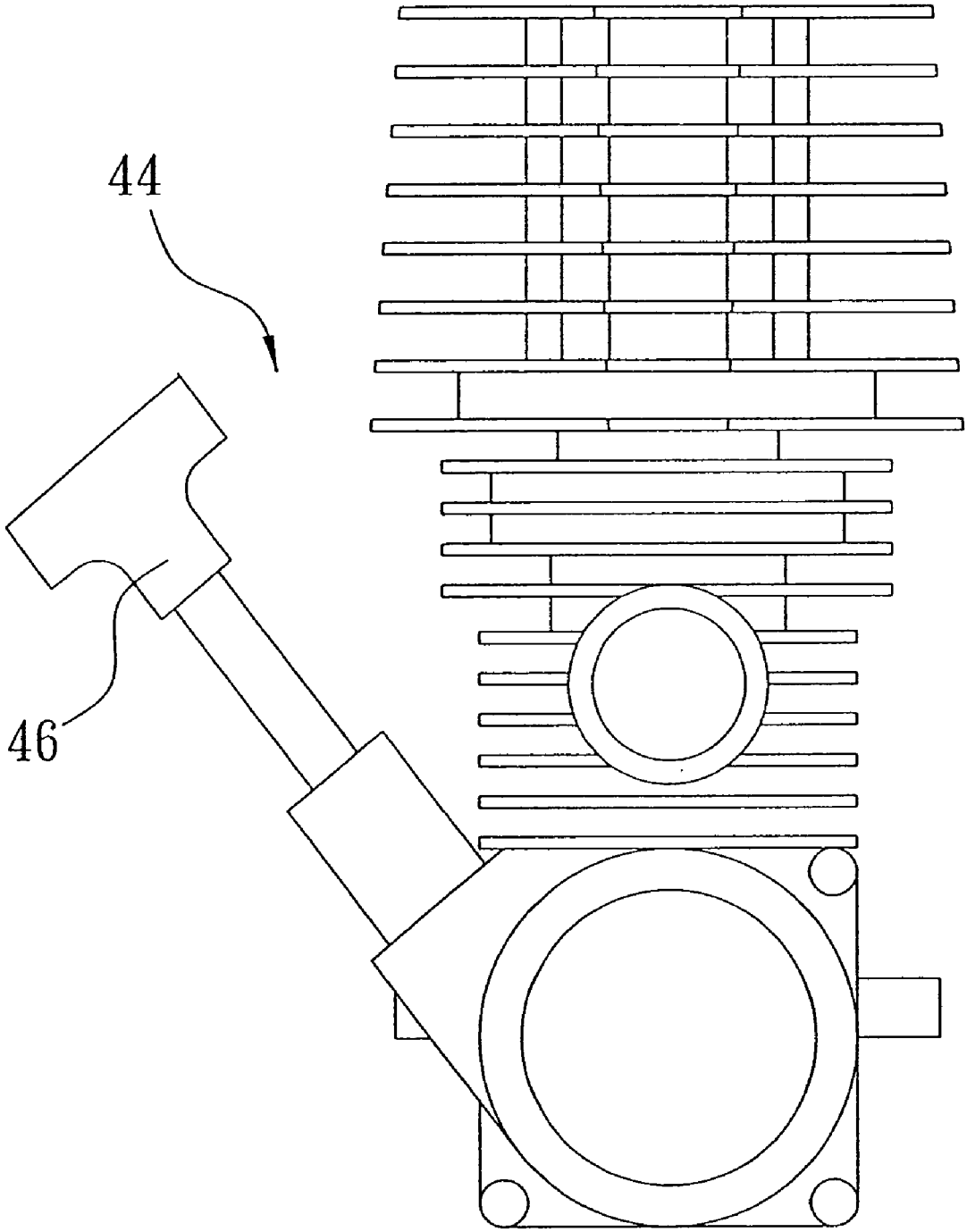
FIG. 12 is a plain view of a traction rope type engine starter according to the prior art.

When assembled, the engine starter can be installed in the engine of a remote-control toy car to replace the conventional traction rope type engine starter. After removal of the traction rope type engine starter, the polygonal center through hole 26 of the driven bevel gear 24 is coupled to the polygonal output shaft 52 of the engine of the remote-control toy car, and then the casing 10 is fixedly fastened to the housing of the engine of the remote-control toy car (see FIGS. 10A and 10B). When installed, the polygonal coupling hole 36 of the driving bevel gear 34 faces vertically downwards for receiving the starter rod 48 of an electric auxiliary starter 56 (see FIG. 11).

Figure 13:
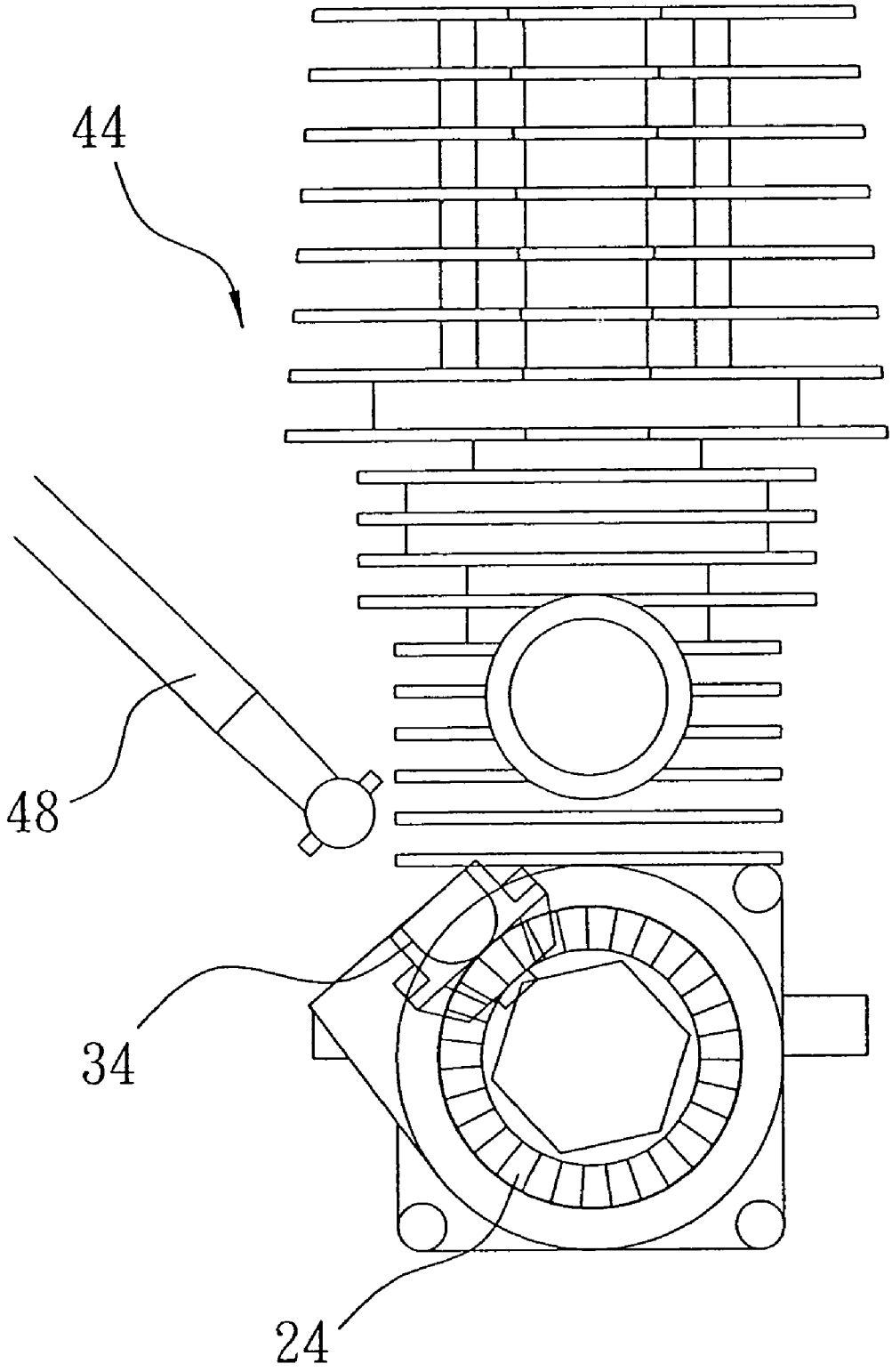
FIG. 13 is a schematic drawing showing the engine starter of the present invention installed in the engine of a conventional toy car after removal of the traction rope type engine starter from the engine with the polygonal coupling hole of the driving bevel gear disposed at one lateral side.
Figure 14:
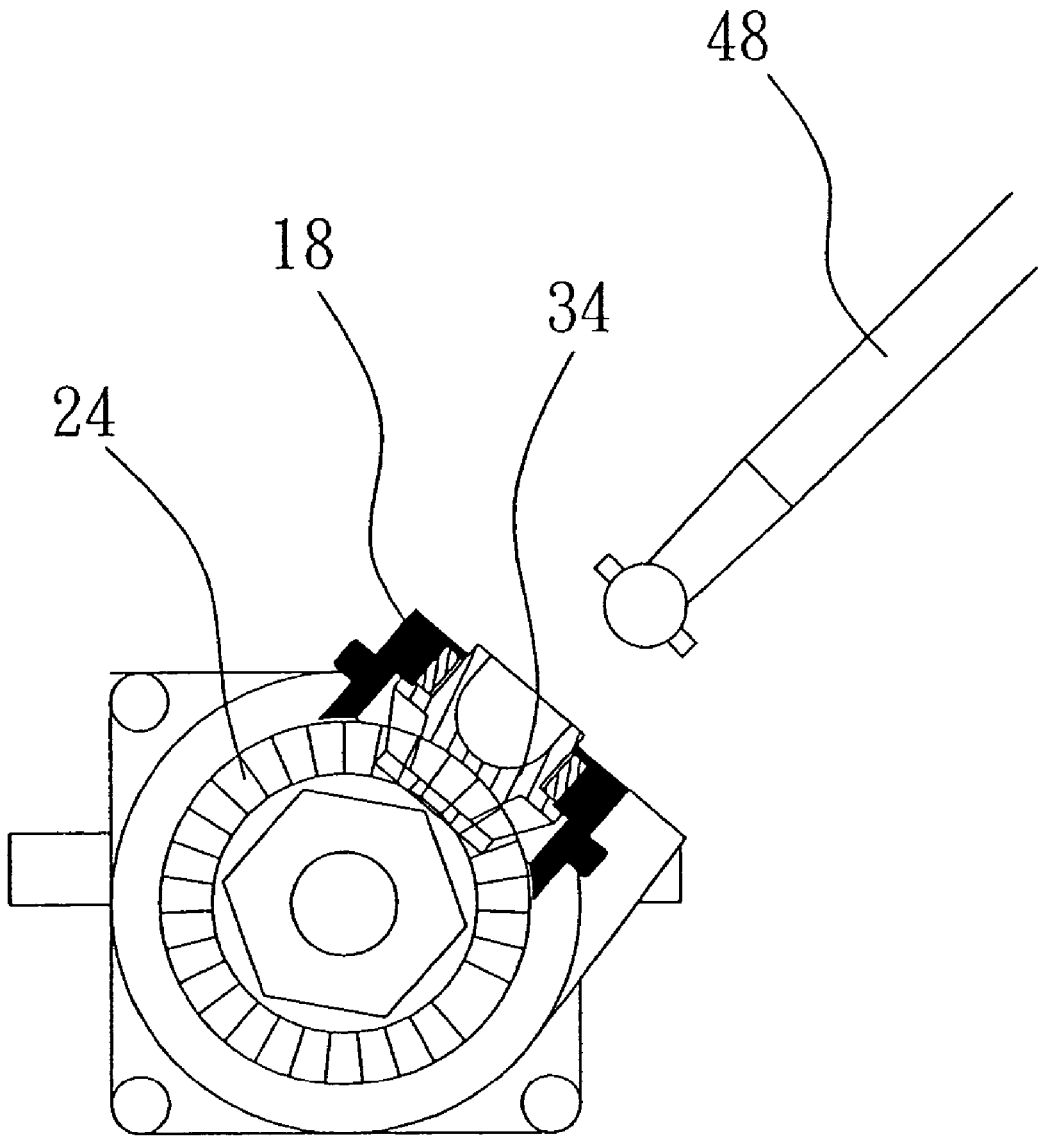
FIG. 14 is similar to FIG. 13 but showing the direction of the engine starter reversed.
Figure 15:
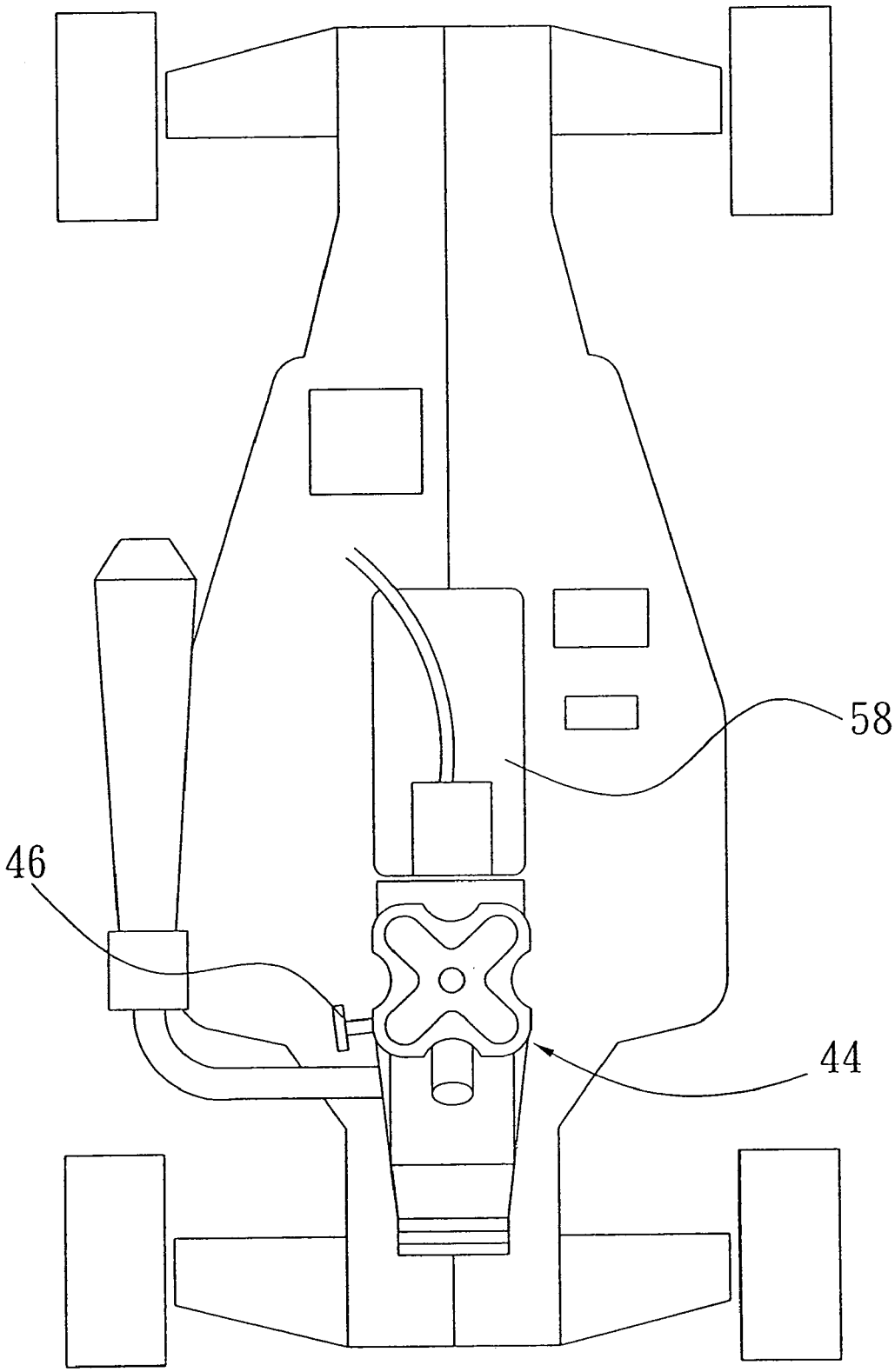
FIG. 15 is a schematic drawing of a traction rope type engine for a remote-control toy car according to the prior art.

Referring to FIGS. 13 and 14, the engine starter 100 can be so arranged that the driving bevel gear 34 is disposed at one lateral side such that the driving bevel gear 34 can be started by the starter rod 48 of the electric auxiliary starter 56 from one lateral side. Either the aforesaid bottom or lateral side loading, the operation of the engine starter 100 is free from the interference of the other parts of the toy car.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An engine starter comprising:

a casing;

a cushion mounted inside said casing, said cushion having an axially extended center through hole;

a driven bevel gear mounted inside said casing, said driven bevel gear having a polygonal center through hole axially aligned with the axially extended center through hole of said cushion;

a driving bevel gear mounted in said casing and meshed with said driven bevel gear, said driving bevel gear having a polygonal coupling hole disposed at one side thereof outside said casing and a coupling rod axially disposed at an opposite side thereof opposite to said polygonal coupling hole;

a locating block mounted on the coupling rod of said driving bevel gear inside said casing;

a locating cap fixedly fastened to said casing to hold said driving bevel gear inside said casing for enabling said driving bevel gear to be rotated relative to said locating cap; and a cover plate covered on said casing to hold said cushion, said driven bevel gear, said driving bevel gear, said locating block and said locating cap in place.

2. The engine starter as claimed in claim 1, wherein said locating block is a flat block having a semicircular notch disposed at one side thereof and forced into engagement with the coupling rod of said driving bevel gear.

3. The engine starter as claimed in claim 1, wherein said locating cap is a polygonal cap fitted into a polygonal hole at said casing.

4. The engine starter as claimed in claim 1, wherein said casing has two sliding grooves symmetrically disposed at two sides; said cover plate has two sliding rails symmetrically disposed at two sides and respectively inserted into said sliding grooves in said casing.

* * * * *